US011774106B2

(12) United States Patent
Kim et al.

(10) Patent No.: US 11,774,106 B2
(45) Date of Patent: Oct. 3, 2023

(54) ELECTRIC RANGE

(71) Applicant: LG ELECTRONICS INC., Seoul (KR)

(72) Inventors: Seunghak Kim, Seoul (KR); Junghyeon Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 13 days.

(21) Appl. No.: 17/520,389

(22) Filed: Nov. 5, 2021

(65) Prior Publication Data

US 2022/0163211 A1 May 26, 2022

(30) Foreign Application Priority Data

Nov. 25, 2020 (KR) ..... 10-2020-0159557

(51) Int. Cl.

| | |
|---|---|
| ***F24C 7/06*** | (2006.01) |
| ***F24C 7/08*** | (2006.01) |
| ***F24C 15/12*** | (2006.01) |
| ***H05B 6/12*** | (2006.01) |

(52) U.S. Cl.

CPC ..... *F24C 7/067* (2013.01); *F24C 7/087* (2013.01); *F24C 15/12* (2013.01); *H05B 6/12* (2013.01); *H05B 2206/02* (2013.01)

(58) Field of Classification Search

CPC ..... F24C 15/12; F24C 7/067; F24C 7/087

See application file for complete search history.

(56) References Cited

U.S. PATENT DOCUMENTS

| | | | | |
|---|---|---|---|---|
| 5,791,336 | A | 8/1998 | Helm | |
| 2008/0185376 | A1* | 8/2008 | Gagas | H05B 6/1263 219/623 |
| 2015/0128927 | A1* | 5/2015 | Nelson | E05D 7/043 126/194 |

FOREIGN PATENT DOCUMENTS

| | | | |
|---|---|---|---|
| EP | 2 473 001 | A1 | 7/2012 |
| EP | 2 981 155 | A1 | 2/2016 |
| JP | 2012-052685 | A | 3/2012 |
| JP | 2012052685 | A * | 3/2012 |

* cited by examiner

*Primary Examiner* — Thien S Tran

(74) *Attorney, Agent, or Firm* — Bryan Cave Leighton Paisner LLP

(57) ABSTRACT

An electric range in one embodiment includes a case and a cover plate coupled to an upper end of the case to allow an object to be heated to be placed on an upper surface thereof The electric range further includes a plurality of heating parts disposed under the cover plate and configured to heat the object to be heated, an upper bracket disposed under the heating part and configured to support the heating part, a base bracket disposed under the upper bracket to allow a printed circuit board to be mounted thereon, and a cover bracket disposed outside the upper bracket and the case coupled to the case and configured to support the cover plate.

19 Claims, 7 Drawing Sheets

ELECTRIC RANGE

CROSS-REFERENCE TO RELATED APPLICATION

This application claims priority to and the benefit of Korean Patent Application No. 10-2020-0159557, filed on Nov. 25, 2020, which is hereby incorporated by reference as if fully set forth.

TECHNICAL FIELD

Disclosed herein is an electric range, and one particular implementation relates to an electric range as a home appliance.

BACKGROUND

Details in the background section do not constitute the related art but are given only as background information concerning the subject matter of the present disclosure.

Various types of cooking appliances are used to heat food at homes or restaurants. For example, a cooking appliance may include a gas range using gas and an electric range using electricity. Also, an electric range may use a resistance heating method and an induction heating method.

An electrical resistance heating method may generate heat by applying electric current to a metallic resistance wire or a non-metallic heat generation element such as silicon carbide to generate heat, and the generated heat is radiated or conducted to heat an object (e.g., a cooking vessel such as a pot, a frying pan, and the like).

An induction heating method may apply high-frequency power to a coil to generate a magnetic field around the coil, and an eddy current produced in the generated magnetic field is used to heat an object made of a metallic material. Thus, when electric current is supplied to a working coil or a heating coil, heat is generated by induction and may heat an object.

The brackets that support various components of an electric range may have a plate-shaped structure. The plate-shaped structure may become deformed due to the load of the components or an external force. Accordingly, there is a growing need for a structure that can improve rigidity of the brackets.

Additionally, in an assembled electric range, the electric range needs to have a structure that can reliably support each component.

Further, there is a growing demand for an electric range having a structure that can facilitate quick and efficient assembly of components.

Furthermore, an electric range having a structure that ensures improvement in electromagnetic compatibility (EMC) and electromagnetic interference (EMI) needs to be developed.

SUMMARY

According to an embodiment of the present disclosure, an electric range may be provided with a cover bracket that may be used to reliably mount a cover plate onto the electric range to form an upper plate of the electric range.

According to an embodiment of the present disclosure, an electric range having a structure with a cover bracket that is readily mounted onto the electric range is provided.

According to an embodiment of the present disclosure an electric range having a structure that ensures improvement in EMC and EMI performance is provided.

An electric range in one embodiment may include a case forming an exterior of the electric range, and a cover plate coupled to an upper end or surface of the case The cover plate may be provided with a cover bracket configured to couple the case and the cover plate.

The case may include a first casing forming a bottom surface of the case, a second casing forming lateral surfaces of the case, and a third casing supporting an upper bracket.

The cover bracket may be provided with a first cover plate coupled to the second casing, and a second cover plate supporting the cover plate.

The cover bracket and the upper bracket may be spaced apart from each other without being coupled to each other. Thus, the upper bracket may not be deformed during a process of mounting the cover bracket onto the electric range.

An electric range in one embodiment may include a case, a cover plate coupled to an upper end or surface of the case to allow an object to be heated to be placed on the upper surface thereof, a plurality of heating parts disposed under the cover plate and configured to heat the object to be heated, an upper bracket disposed under the heating part to support the heating part, a base bracket disposed under the upper bracket to allow a printed circuit board to be mounted thereon, and a cover bracket disposed outside the upper bracket and the case and coupled to the case to support the cover plate.

The case may include a first casing forming a bottom surface of the case, a second casing bent from the first casing to form lateral surfaces of the case, and a third casing bent from the second casing to support the upper bracket.

The cover bracket may include a first cover plate disposed to face the second casing and coupled to the second casing, and a second cover plate bent from the first cover plate to support the cover plate.

The first cover plate may be provided with a first passage hole, and the second casing may be provided with a second passage hole corresponding to the first passage hole. Additionally, a screw bolt may be fastened to the first passage hole and the second passage hole such that the cover bracket is coupled to the cover plate.

The first cover plate may further include a hole forming part protruding downward, in a portion in which the first passage hole is formed.

The first passage hole may be formed into a slot hole in which a diameter of a long axis of the slot hole is greater than a diameter of a short axis of the slot hole.

The upper bracket may include a first upper plate forming a bottom surface of the upper bracket, and a second upper plate bent from the first upper plate and disposed to face the first cover plate.

According to and embodiment of the present disclosure, a cover plate of an electric range may be reliably mounted onto a case by using a cover bracket.

In one embodiment of the electric range of the present disclosure, a second upper plate may not be deformed by an external force during a process of mounting the cover bracket. Thus, a process of correcting the deformation of the second upper plate is not required, and a worker or installer can mount the cover bracket onto the electric range readily.

In one embodiment of the electric range of the present disclosure, since the second upper plate is not deformed during the process of mounting the cover bracket, the second upper plate may be mounted onto the electric range, as designed, thereby preventing a deterioration or reduction of EMC and EMI performance, which would be caused by the deformation of the second upper plate. As a result, EMC and EMI performance of the electric range may improve.

Specific effects are described along with the above-described effects in the section of Detailed Description.

Aspects, features, and advantages of the present disclosure are not limited to those described above. It is understood that other aspects, features, and advantages not mentioned above can be clearly understood from the following description and can be more clearly understood from the embodiments set forth herein. Additionally, it is understood that various aspects, features, and advantages described herein can be realized via means and combinations thereof that are described in the appended claims.

BRIEF DESCRIPTION OF DRAWINGS

The accompanying drawings constitute a part of the specification, illustrate one or more embodiments in the disclosure, and together with the specification, explain the disclosure.

DETAILED DESCRIPTION

Figure 1:
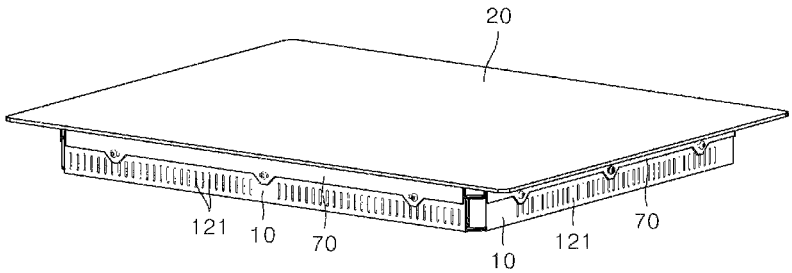
FIG. 1 is a perspective view showing an electric range according to an embodiment of the present disclosure.

Reference will now be made to the exemplary embodiments illustrated in the drawings, and specific language will be used here to describe the same. It will nevertheless be understood that no limitation of the scope of the invention is thereby intended. Alterations and further modifications of the inventive features illustrated here, and additional applications of the principles of the inventions as illustrated here, which would occur to a person skilled in the relevant art and having possession of this disclosure, are to be considered within the scope of the invention.

The terms "first", "second" and the like are used herein only to distinguish one component from another component. Thus, the components should not be limited by the terms. Certainly, a first component can be a second component unless stated to the contrary Throughout the disclosure, each component can be provided as a single one or a plurality of ones, unless explicitly stated to the contrary.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

Throughout the disclosure, "a vertical direction" refers to a vertical direction of an electric range when the electric range is disposed for normal use. "A horizontal direction" refers to a direction orthogonal to the vertical direction, and a forward and rearward direction refers to a direction orthogonal to both the vertical direction and the horizontal direction. "Bilateral direction" or "a lateral direction" has the same meaning as the horizontal direction, and these terms may be used interchangeably herein.

Various terminology used herein can imply direct or indirect, full or partial, temporary or permanent, action or inaction. For example, when an element is referred to as being "on," "connected" or "coupled" to another element, then the element can be directly on, connected or coupled to the other element or intervening elements can be present, including indirect or direct variants. In contrast, when an element is referred to as being "directly connected" or "directly coupled" to another element, there are no intervening elements present.

Figure 2:
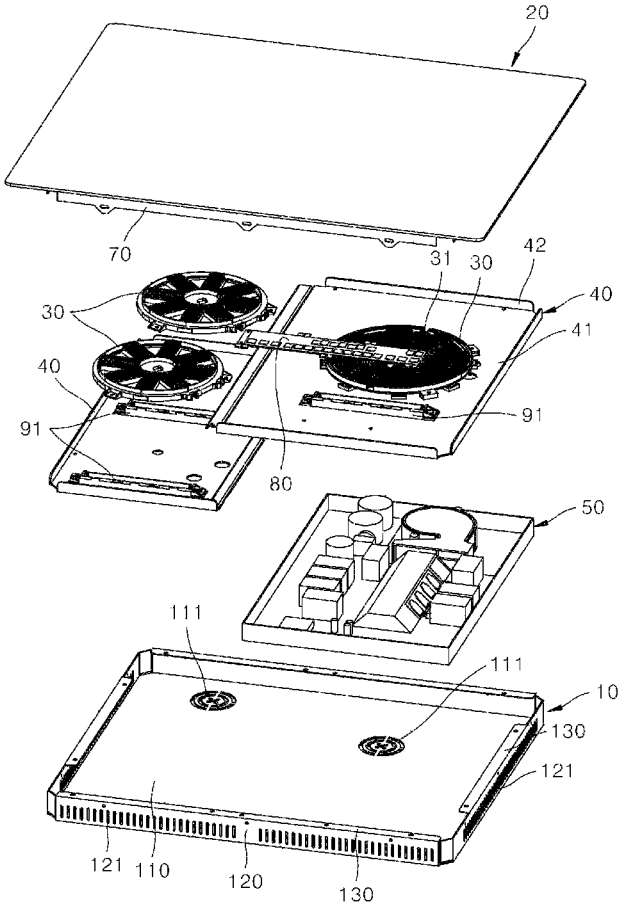
FIG. 2 is an exploded perspective view showing the electric range according to an embodiment of the present disclosure.

FIG. 1 is a perspective view showing an electric range according to an embodiment of the present disclosure. FIG. 2 is an exploded perspective view showing the electric range according to an embodiment of the present disclosure.

The electric range according to an embodiment of the present disclosure may heat an object based on induction heating. In this example, the object may be a cooking vessel containing a metallic material such as stainless steel, iron and the like.

In one exemplar induction heating process, high-frequency power may be supplied to a working coil 31 to generate a magnetic field around the working coil 31, and an object to be heated made of a metallic material may be heated using an eddy current generated by the generated magnetic field.

That is, a heating part 30 having a structure with a working coil 31 adjacent to a ferrite core 330 may supply a high-frequency power to the working coil 31 to generate a magnetic field around the working coil 31, and when an object to be heated is placed in an area of the generated magnetic field, an eddy current caused by the magnetic field may flow through the object to cause Joule heating, thereby heating the object. Accordingly, a cooking vessel may be the object to be heated by induction, and a food item contained in the cooking vessel may be heated and cooked.

According to an embodiment of the present disclosure, an electric range may include a case 10, a cover plate 20, a heating part 30, an upper bracket 40, and a base bracket 50.

The case 10 may protect the electric range and the components constituting the electric range. For example, the case 10 may be made of aluminum, but is not limited thereto.

The case 10 may be thermally insulated to suppress release of heat generated by the working coil 31 to outside.

Various components such as the heating part 30, the working coil 31, the upper bracket 40, a control board 80 and the like constituting the electric range may be stored or disposed in the case 10. The case 10 may include an opening, and the opening may be closed by the cover plate 20. The case 10 may have a cubical shape (or any other suitable shape), which may be formed as a result of processing plate-shaped materials.

The case 10 may include a first casing 110, a second casing 120 and a third casing 130.

The first casing 110 may be configured to define a bottom surface of the case 10. The first casing 110 may support the various components described above in accordance with embodiments of the electric range.

The first casing 110 may include at least one set of vent holes 111 through which air may flow or communicate, and the vent holes 111 may cool a printed circuit board 51 and the circuit element components mounted onto the printed circuit board 51 disposed on the first casing 110.

The second casing 120 may bend from the first casing 110 to form or define lateral or side surfaces of the case 10. The second casing 120 may bend from edges of the first casing 110 in an up-down or vertical direction to define the lateral or side walls of the electric range. The second casing 120 may surround the lateral or side walls of the base bracket 50.

The second casing 120 may be disposed on each side of the first casing 110 to form or define a substantially rectangular shape. The second casing 120 may improve or reinforce the rigidity of the case 10.

That is, the second casing 120 bent from the first casing 110 may reduce or suppress the plate-shaped first casing 100 from bending (or deformed) or being damaged by the weight of the built-in or internal components thereof or an external force.

The second casing 120 may further include a plurality of exhaust holes 121 formed into or defining slits. The plurality of exhaust holes 121 may be configured to communicate air from inside of the case 10 to outside of the case 10. Accordingly, the exhaust holes 121 may cool the components stored or disposed in the case 10.

The third casing 130 may bend from the second casing 120, and may support the upper bracket 40. The third casing 130 may be disposed on each side of the first casing 110.

A first upper plate 41 forming a bottom surface of the upper bracket 40 may be mounted onto an upper or top surface of the third casing 130, and the first upper plate 41 and the third casing 130 may be coupled to each other by a coupling tool such as a bolt and the like.

The cover plate 20 may be coupled to an upper or top end or portion of the case 10, and an object to be heated may be disposed on the upper or top surface of the cover plate 20. The cover plate 20 may close the open upper or top portion of the case 10 and may protect the components stored or disposed in the case 10.

An object to be heated may be placed on the upper or top surface of the cover plate 20, and a magnetic field generated in the heating part 30 may pass through the cover plate 20 and reach the object to be heated. The cover plate 20, for example, may be made of a material containing ceramics, but is not limited thereto.

An input interface may be disposed on the upper or top surface of the cover plate 20, and the input interface may receive an input from a user. The input interface may be disposed in an area of the upper or top surface of the cover plate 20, and may display an image. It is understood that the input interface is not limited to any specific location.

The input interface may receive a touch input from the user, and the electric range of the present disclosure may operate based on the received touch input.

For example, the input interface may be a module for inputting a heating intensity or a heating period and the like desired by the user, and may be implemented as a physical button or a touch panel and the like.

For example, the input interface may be a thin film transistor liquid crystal display (TFT LCD), but is not limited thereto.

The control board 80 may be disposed under the cover plate 20, and the control board 80 may be used to input or provide an instruction to operate to the electric range of the present disclosure. The control board 80 may include or be provided with a plurality of key switches, and the user may input an instruction or command to the control board 80 through the key switches for controlling the operation of the electric range of the present disclosure.

In one embodiment of the electric range, an upper surface of the control board 80 may contact or be adjacent to the lower or bottom surface of the cover plate 20. In this embodiment, the control board 80 may be disposed at or about a position corresponding to the position of the input interface.

The control board 80 and the input interface may be connected to each other to facilitate electrostatic touch input. Thus, when a user inputs a control instruction on the input interface, the control instruction may be input or transmitted to the control board 80.

Additionally, a display may be disposed at or about an area on the upper or top surface of the cover plate 20, and the display may display a driving state of the electric range. It is understood that the display is not limited to any specific location.

A light display area may be formed on the upper or top surface of the cover plate 20. A light source unit 91 may be disposed under the cover plate 20, and the light rays emitted from the light source unit 91 may be delivered to the user through the light display area. In this case, the light display area and the light source unit 91 may be disposed in positions that correspond with each other. When a plurality of light source units 91 is provided, the same number of light display areas as the number of light source units 91 may be provided on the upper or top surface of the cover plate 20.

The electric range in an embodiment of the present disclosure may further include a cover bracket 70 for supporting the cover plate 20. The cover bracket 70 is described hereafter with reference to FIGS. 2, 4, and 5.

The cover bracket 70 may be disposed outside the upper bracket 40 and the case 10. The cover bracket 70 may be coupled to the case 10 and may support the cover plate 20. For example, the cover bracket 70 may be coupled to the case 10 by a screw bolt 900 (Later described in detail in FIG. 9).

A plurality of cover brackets 70 may be provided, and each of the plurality of cover brackets 70 may be disposed in a portion corresponding to each side of the cover plate 20 formed into a rectangular shape. Accordingly, a total of four cover brackets 70 may be provided such that each of the plurality of cover brackets 70 may be disposed on each side of the rectangle-shaped cover plate 20.

The cover bracket 70 may include a first cover plate 710 and a second cover plate 720. The first cover plate 710 may be disposed to face the second casing 120 and may be coupled to the second casing 120. The second cover plate 720 may be bent from the first cover plate 710 and may support the cover plate 20.

The cover plate 20 may be mounted onto an upper or top surface of the second cover plate 720, and the second cover plate 720 and the cover plate 20 may be coupled to each other by an adhesive, for example. However, the method for coupling the second cover plate 720 and the cover plate 20 may not be limited.

A plurality of heating parts 30 may be provided, disposed under the cover plate 20 to heat the object to be heated. In the embodiment, the plurality of heating parts 30 may be provided to operate based on an induction heating method.

In another embodiment, some of the plurality of heating parts 30 may be based on induction heating, and the remaining heating parts 30 may be provided as a highlight heating apparatus based on electrical resistance heating. That is, the electric range in one embodiment of the present disclosure may be provided as a hybrid range.

Hereunder, an electric range in accordance with an embodiment of the present disclosure is described with all of the plurality of heating parts 30 being based on an induction heating method is described.

The heating parts 30 may be mounted onto the upper bracket 40, and in one embodiment, a total of three heating parts 30 may be provided. It is understood that the number of heating parts 30 may not be limited. When a plurality of heating parts 30 is provided, the same number of upper brackets 40 supporting the heating parts 30 may be provided as the number of heating parts 30.

The heating parts 30 may be provided with a core frame 320, a working coil 31 may be spirally wound around an upper surface of the core frame 320, and a ferrite core 330 may be mounted onto a lower or bottom surface of the core frame 320. Accordingly, when the working coil 31 is supplied with high-frequency power, a magnetic field may be formed around the ferrite core 330, and an eddy current may be formed in the object to be heated due to the magnetic field.

The heating parts 30 are described below with reference to the following drawings.

Figure 3:
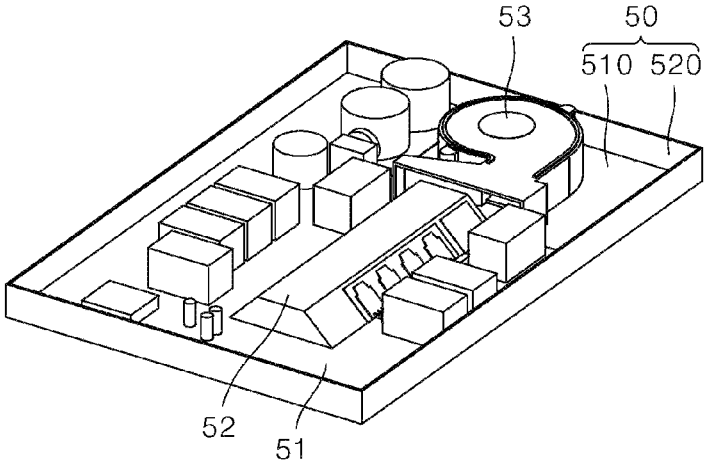
FIG. 3 is a perspective view showing an base bracket and components mounted onto the upper bracket according to an embodiment of the present disclosure.
Figure 4:
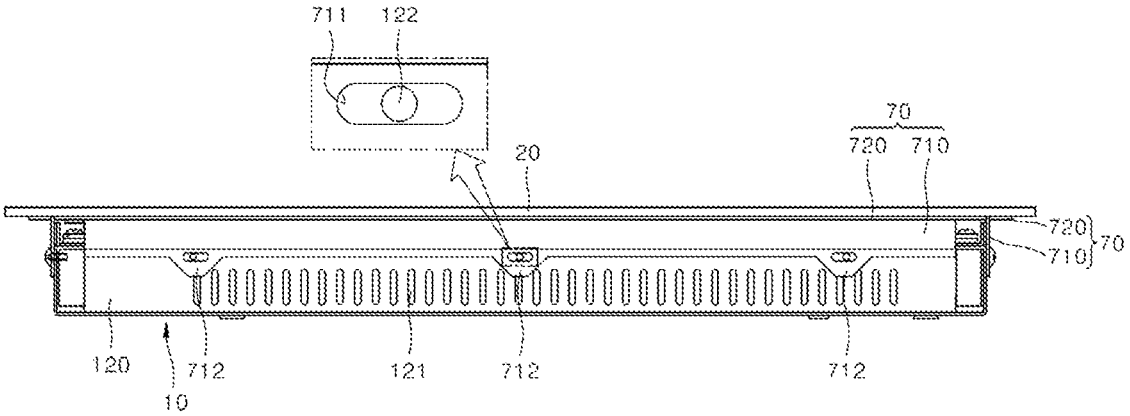
FIG. 4 is a front view showing the electric range according to an embodiment of the present disclosure.

FIG. 3 is a perspective view showing a base bracket 50 and components mounted onto the base bracket 50 in one embodiment. FIG. 4 is a front view showing the electric range in one embodiment.

Figure 5:
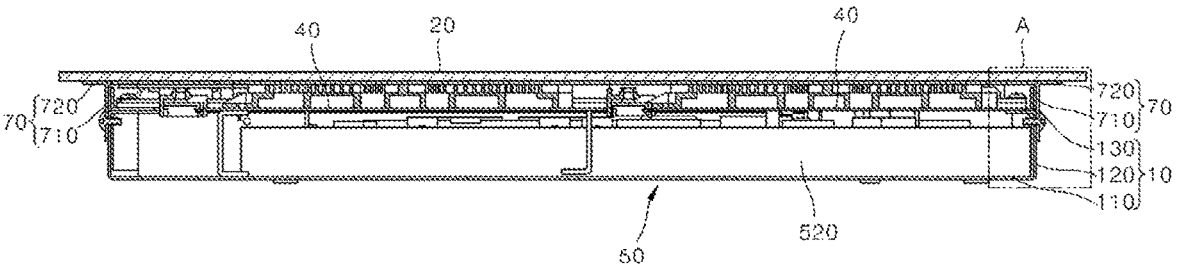
FIG. 5 is a cross-sectional view of the electric range according to the embodiment shown FIG. 4.
Figure 6:
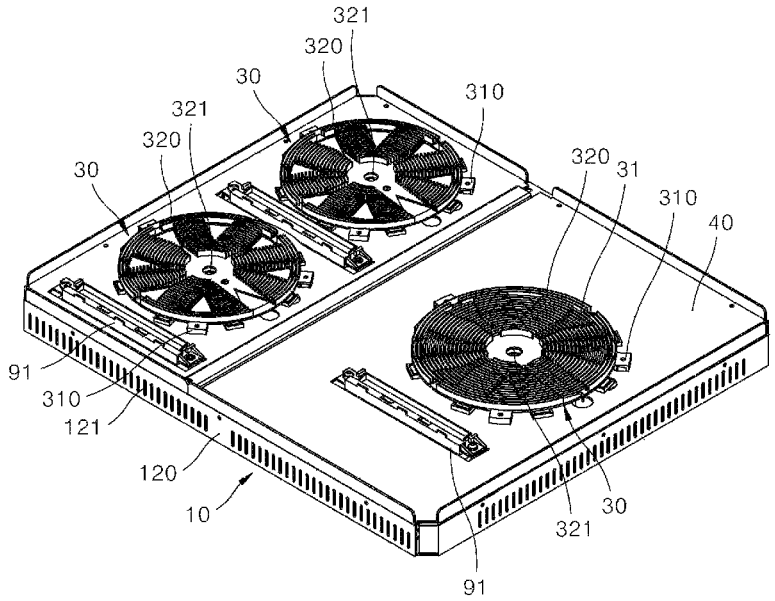
FIG. 6 is a perspective view showing the electric range according to an embodiment in FIG. 1, and for clarity of description and illustration, some components are omitted.

FIG. 5 is a cross-sectional view of FIG. 4. FIG. 6 is a perspective view showing the electric range in FIG. 1 without some components for ease of discussion.

The upper bracket 40 may be disposed under the heating part 30 and support the heating part 30. In one embodiment, a plurality of upper brackets 40 may be provided. The upper brackets 40 may be made of aluminum, for example, but is not limited thereto.

The upper bracket 40 may include a first upper plate 41 and a second upper plate 42. The first upper plate 41 may form a bottom surface of the upper bracket 40, and the heating part 30 may be mounted onto the first upper plate 41.

The first upper plate 41 may be provided to cover a printed circuit board 51 that may be disposed under the first upper plate 41 in the vertical or up-down direction. When a plurality of upper brackets 40 is provided, a single first upper plate 41, or a plurality of first upper plates 41 that may be coupled to one another may cover the printed circuit board 51 depending on the surface area of the printed circuit board 51.

With the structure, the first upper plate 41 may block an electromagnetic field and electronic magnetic waves, generated from the heating part 30, from reaching the printed circuit board 51 and other elements mounted onto the printed circuit board 51.

That is, the upper bracket 40 may improve the electromagnetic compatibility (EMC) and electromagnetic interference (EMI) performance of the printed circuit board 51.

One or more second upper plates 42 may be formed by bending the first upper plate 41 in the vertical or up-down direction of the electric range. The second upper plates 42 may bend from the edges of the first upper plate 41 in the vertical or up-down direction.

The second upper plates 42 may be disposed on or about each side of the first upper plate 41 to form a substantially rectangular shape. When a plurality of upper brackets 40 is provided, the second upper plates 42 may be formed on each side of the first upper plate 41 except on or about adjacent sides of the upper brackets 40.

The second upper plate 42 improves the rigidity of the upper bracket 40. That is, the second upper plates 42 bent from the first upper plate 41 reduce the possibility of bending or damaging the plate-shaped first upper plate 41 due to the weight of the built-in components including the heating parts 30 or an external force.

A light source unit 91 may be disposed on the upper bracket 40. For example, the light source unit 91 may be disposed on the printed circuit board 51 disposed under the upper bracket 40, and the upper bracket 40 may have an opening disposed at or about the position corresponding to a position of the light source unit 91. In one embodiment, the light source unit 91 may be disposed on the bracket, and electrically connect to the printed circuit board 51 under the upper bracket 40.

As described above, a light display area may be formed in a portion of the cover plate 20, corresponding to the light source unit 91. It is understood that the position of the light display area is not specifically limited.

The light source unit 91 may be provided in a way or manner such that a plurality of LEDs may be aligned in a row, for example. The light source unit 91 may light up when the heating parts 30 operate to inform the user whether the heating parts 30 is in operation. Alternatively, at the light source unit 91, various lit-up shapes and colors of the plurality of LEDs may change to inform the user of the operation state of the electric range.

The number of light source units 91 may be determined based on the number of heating parts 30. As shown in FIG. 6, three light source units 91 may be provided based on the three heating parts 30. However, the number of light source units 91 is not limited.

A base bracket 50 may be disposed under the upper bracket 40, and may include a bottom plate 510 and a lateral plate 520, and the printed circuit board 51 may be mounted onto the base bracket 50. The bottom plate 510 may form a bottom surface of the base bracket 50, and the printed circuit board 51 may be mounted onto an upper or top surface of the base bracket 50 or the bottom plate 510.

The lateral plate 520 may be formed by bending from the bottom plate 510 in the vertical or up-down direction of the electric range. The lateral plate 520 may bend at or around the edges of the bottom plate 510 in the vertical or up-down direction.

The lateral plate 520 may be disposed on each side of the bottom plate 510 to from a substantially rectangular shape. In one example, a plurality of upper brackets 40 may be provided, and the lateral plate 520 may be formed on each side of the bottom plate 510 except for the adjacent sides of the upper brackets 40.

The lateral plate 520 improves the rigidity of the base bracket 50. That is, the lateral plate 520 bent from the bottom plate 510 may reduce the possibility of a bending or damaging the plate-shaped bottom plate 510 due to the weight of the built-in components such as the printed circuit board 51 and the like or an external force.

The printed circuit board 51 may include a controller, receive power from an external power source, and may be configured to communicate with an external device in a wired or wireless manner.

The printed circuit board 51 may electrically connect to the control board 80 to receive instructions input by a user on the control board 80. The printed circuit board 51 may electrically connect to the light source unit 91 and the working coil 31 to control the operation of the light source unit 91 and the working coil 31.

Referring to FIG. 3, a heat sink 52, active elements including an air blowing fan 53, and passive elements may be mounted onto the printed circuit board 51, and an electric circuit may be formed on the printed circuit board 51.

The heat sink 52 may cool the heat inside the case 10 to protect the components stored or disposed in the case 10. The heat sink 52 may be mounted onto the printed circuit board 51, and cool the heat generated on the printed circuit board 51. Further, the heat sink 52 may cool the heat that is generated by an electromagnetic interaction as a result of the operation of the heating part 30.

For example, the heat sink 52 may have a plurality of cooling fins, and an air guide that may be configured to cover the cooling fins and to guide the flow of air.

The air blowing fan 53 may be mounted onto the printed circuit board 51. In this example, as illustrated in FIG. 3, a guide wall for guiding the flow of air may be formed at or about an air outlet of the air blowing fan 53 in a direction in which the heat sink 52 may be disposed such that the air, forced to flow by the air blowing fan 53, flows to the heat sink 52.

As a result of the operation of the air blowing fan 53, air inside the case 10 may flow to the heat sink 52, and the inside of the case 10 may be cooled by the heat sink 52.

Figure 7:
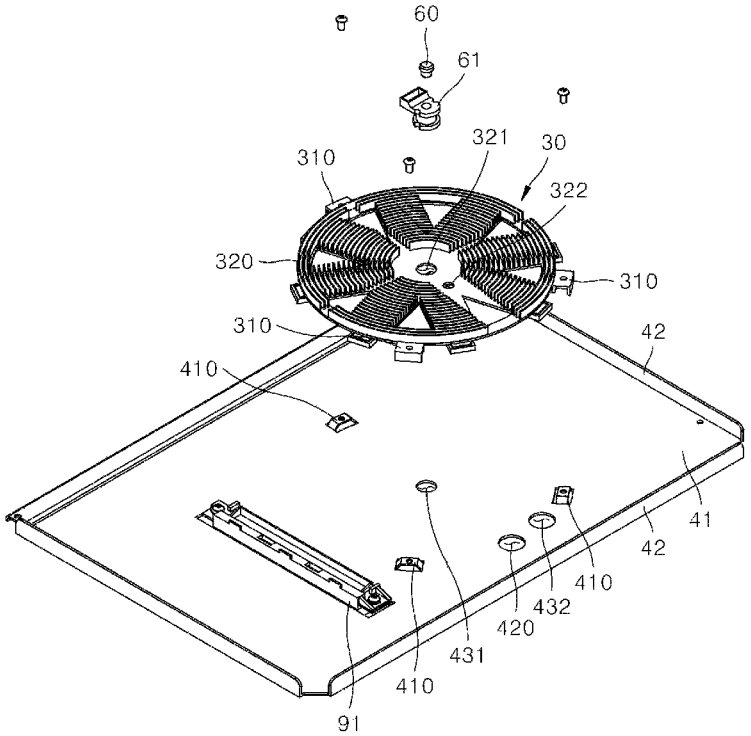
FIG. 7 is an exploded perspective view showing some of the components of the electric range according to the embodiment shown in FIG. 6.
Figure 8:
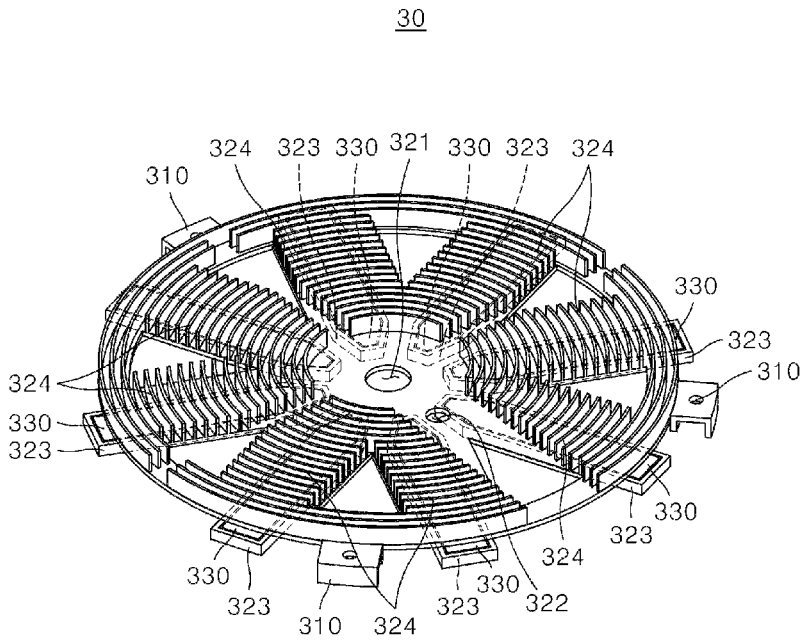
FIG. 8 is a perspective view showing an example heating part according to an embodiment of the present disclosure.

FIG. 7 is an exploded perspective view showing some of the components of the electric range in accordance with an embodiment shown in FIG. 6. FIG. 8 is a perspective view showing a heating part 30 in one embodiment. In FIGS. 7 and 8, a working coil 31 is omitted for clarity of description and illustration.

In one embodiment, the heating part 30 may be mounted onto the upper bracket 40 with one or more coupling parts. The coupling parts may be formed at the corresponding portions of the heating part 30 and the upper bracket 40 to couple the heating part 30 and the upper bracket 40 accordingly.

The upper bracket 20 may be provided with one or more first coupling parts 410 protruding from and coupled to the heating part 30. The heating part 30 may be provided with one or more second coupling parts 310 corresponding to the first coupling parts 410.

A plurality of second coupling parts 310 may be provided, and each of the plurality of second coupling parts 310 may be disposed radially on an edge of the heating part 30 and may be spaced apart from one another in a circumferential direction. The same number of first coupling parts 410 as the number of second coupling parts 310 may be provided, and the first coupling parts 410 may be formed in positions corresponding to the positions of the second coupling parts 310 on the upper bracket 40.

The first coupling part 410 and the second coupling part 310 may be fastened by a coupling tool such as a bolt and the like, and may be coupled to each other, for example.

The electric range in one embodiment may further include a temperature sensor 60 disposed at or about a central portion of the core frame 320. The core frame 320 may have a mounting hole 321 onto which the temperature sensor 60 may be mounted, in the central portion thereof.

The temperature sensor 60 may be electrically connected to the printed circuit board 51 provided under the upper bracket 40 by a cable. Accordingly, the cable connecting the temperature sensor 60 and the printed circuit board 51 may be installed in a way or manner that the cable passes through the upper bracket 40. Accordingly, the upper bracket 40 may have a cable inserting hole 420 into which the cable of the temperature sensor 60 may be inserted.

In one embodiment, the electric range may further include a sensor bracket 61 to mount the temperature sensor 60 onto the core frame 320. The temperature sensor 60 may be mounted onto the sensor bracket 61, and the sensor bracket 61 may be detachably mounted onto the mounting hole 321.

The temperature sensor 60 may measure a temperature of the heating part 30 during the operation of the electric range of the present disclosure. The heating part 30 provided based on an induction heating method may not generate high-temperature heat on its own. However, the heating part 30 may generate heat due to the electromagnetic interaction, even with the heat with a low temperature.

The heat generated by the heating part 30 may adversely affect not only the heating part 30 but also the printed circuit board 51 disposed under the heating part 30 and various types of components included in the printed circuit board 51. To reduce or prevent the effects of the heat, the temperature of the heating part 30 may be measured, and when the measured temperature exceeds a predetermined value, appropriate measures may be taken accordingly in the electric range.

For example, the controller may receive information on the temperature of the heating part 30 measured by the temperature sensor 60, and when the temperature of the heating part 30 exceeds the predetermined value, the controller may stop the operation of the electric range or control the air blowing fan 53 to increase the cooling capacity.

The core frame 320 may have a first inserting hole 322 into which the working coil 31 mounted onto the core frame 320 may be inserted. The first inserting hole 322 may be formed at or about a position spaced in a diameter or radial direction from the mounting hole 321 at or about the central portion of the core frame 320.

The working coil 31 may pass through the first inserting hole 322, may be inserted into an upper surface of the central portion of the core frame 320, may be wound spirally around a guide rail 324 disposed on the upper or top surface of the core frame 320, and then may be withdrawn outward from an edge portion of the core frame 320.

The working coil 31 may be electrically connected to the printed circuit board 51 disposed under the upper bracket 40. Accordingly, the upper bracket 40 may have an inserting hole into which the working coil 31 may be inserted through the inserting hole.

The inserting hole may include a second inserting hole 431 and a third inserting hole 432, and the second inserting hole 431 and the third inserting hole 432 may be formed on the upper bracket 40. The working coil 31 inserted into the core frame 320 may be inserted into the second inserting hole 431. The working coil 31 withdrawn from the core frame 320 may be inserted into the third inserting hole 432.

For the working coil 31 to be disposed readily, the second inserting hole 431 may be provided near the position corresponding to a position of the first inserting hole 322, and the third inserting hole 432 may be provided near the edge of the core frame 320, for example.

The working coil 31 may pass through the second inserting hole 431 of the upper bracket 40 from the printed circuit board 51, may pass through the first inserting hole 322 formed on the core frame 320, and may be inserted into the upper or top surface of the central portion of the core frame 320.

The working coil 31 may move to the edge of the core frame 320 while being wound spirally around the guide rail 324 disposed on the upper surface of the core frame 320. Thereafter, the working coil 31 may be withdrawn out of the core frame 320.

The working coil 31 withdrawn out of the core frame 320 may pass through the third inserting hole 432 formed on the upper bracket 40, and may connect to the printed circuit board 51 again.

The heating part 30 is further described with reference to FIG. 8 hereinafter.

The heating part 30 may include a working coil 31, a core frame 320, and a ferrite core 330. In FIG. 8, the working coil 31 is omitted for clarity of description and illustration of the structure of the heating part 30. The heating part 30 around which the working coil 31 is wound is illustrated in the other drawings. Accordingly, the subject matter of the present disclosure can be understood without difficulty by a person having ordinary skill in the art.

The working coil 31 may receive high-frequency power to generate a magnetic field. The working coil 31 may be made of a Litz wire exhibiting excellent or high durability, for example, but is not limited thereto.

The ferrite core 330 may be mounted onto the lower or bottom surface of the core frame 320, and the working coil 31 may be wound around the upper or top surface of the core frame 320. A plurality of channels 323 may be provided radially on the lower or bottom surface of the core frame 320. The ferrite core 330 may be mounted onto or in the channels 323. The same number of channels 323 as the number of ferrite cores 330 may be provided.

Each of the plurality of channels 323 may include a mounting groove onto which the ferrite core 330 may be mounted, and a guideline protruding from the lower or bottom surface of the core frame 320 to form or define the mounting groove.

As illustrated in FIG. 8, a ferrite core 330 may protrude from an edge of the core frame 320 in a diameter or radial direction of the core frame 320. Accordingly, the guideline may only be formed at or about the edge portion, without the mounting groove.

The plurality of channels 323 may be formed such that the plurality ferrite cores 330 may be radially spaced apart by a predetermined distance from one another in a circumferential direction of the core frame 320, as shown in FIG. 8.

As illustrated in FIG. 8, the first inserting hole 322 into which the working coil 31 may be inserted may be formed between two adjacent ferrite cores 330 at or about the central portion of the core frame 320. Accordingly, to prevent interference between the ferrite cores 330 and the first inserting hole 322, the channels 323 disposed in positions adjacent to the first inserting hole 322 may be spaced apart from the central portion of the core frame 320 in the circumferential direction by a distance sufficiently greater than the diameter of the first inserting hole 322, for example.

The guide rails 324 around which the working coil 31 is wound may be formed on an upper or top surface of the ferrite core 330. The guide rails 324 may protrude from the upper or top surface of the core frame 320 and may be formed into a spiral or semi-circular shape such that the working coil 31 mounted onto the core frame 320 may be guided by the guide rail 324 and wound spirally.

A plurality of guide rails 324 may be provided in the diameter or radial direction of the core frame 320. The working coil 31 may be mounted onto the grooves formed among or between the plurality of guide rails 324 and may be wound around the guide rails 324.

An adhesive may be applied to the guide rails 324 and the grooves among or between the guide rails 324, to reliably fix or attach the working coil 31 to the upper or top surface of the core frame 320, and the working coil 31 may adhere to the upper or top surface of the core frame 320.

For example, to electrically insulate the working coil 31, the adhesive may be made of an insulating material.

A space may be formed in or about a portion of the lower or bottom surface of the core frame 320, in which the ferrite core 330 is not installed. Accordingly, the guide rails 324, as illustrated in FIG. 8, may be formed discontinuously in the circumferential direction of the core frame 320.

However, the guide rails 324 may be formed into a spiral or semi-circular shape from the central portion of the core frame 320 toward the edge thereof, and the working coil 31 may be wound around the guide rails 324 to be disposed in a spiral or semi-circular shape from the central portion of the core frame 320 toward the edge thereof.

That is, the working coil 31 may be inserted into the upper or top surface of the core frame 320 by passing through the first inserting hole 322, and may be wound around the guide rails 324 to be formed into a spiral or semi-circular shape, and withdrawn outward from the edge of the core frame 320.

A plurality of ferrite cores 330 may be provided and mounted onto the channel 323, and may be disposed under the core frame 320. Each of the ferrite cores 330 may be coupled to the corresponding mounting groove of the channels 323 by an adhesive. However, a coupling method of the ferrite core 330 may not be limited.

In one embodiment, when the working coil 31 is supplied with high-frequency power, a magnetic field may be generated around the ferrite core 330, and when an object to be heated is placed in or about an area in which the magnetic field is generated, an eddy current may be generated in the object to be heated, and may cause Joule heat to heat the object.

The case 10, the cover bracket 70, and the structures in relation to the case 10 and the cover bracket 70 are further described in detail with reference to FIGS. 1 and 4.

The case 10 may be formed into a box or a cubical shape having an substantially rectangular shape. Accordingly, a plurality of second casings 120 of the case 10 may be provided to form on each side of the rectangle-shaped box or cube. In this example, to facilitate air to flow between inside and outside of the case 10, the exhaust holes 121 may be formed on all of the second casings 120.

Thus, each of the exhaust holes 121 may be spaced apart from one another on each side of the first cover plate 710 and may surround the base bracket 50. With the structure, air may smoothly flow to the air blowing fan 53, the heat sink 52 and the printed circuit board 51 that may be mounted onto the base bracket 50, thereby effectively cooling the printed circuit board 51.

A plurality of cover brackets 70 may be provided. In this example, the cover bracket 70 may be disposed in or about a portion corresponding to each side of the cover plate 20 formed into a rectangular shape.

In one embodiment, the second cover plates 720 of four cover brackets 70 may respectively support a lower or bottom surface of a portion adjacent to or about each side of the rectangle-shaped cover plate 20. An adhesive may be interposed between the second cover plate 720 of the cover bracket 70 and the lower or bottom surface of the cover plate 20 to fix or couple the cover bracket 70 and the second cover plate 720.

In this embodiment, the cover plate 20 may be reliably supported by the four cover brackets 70.

Figure 9:
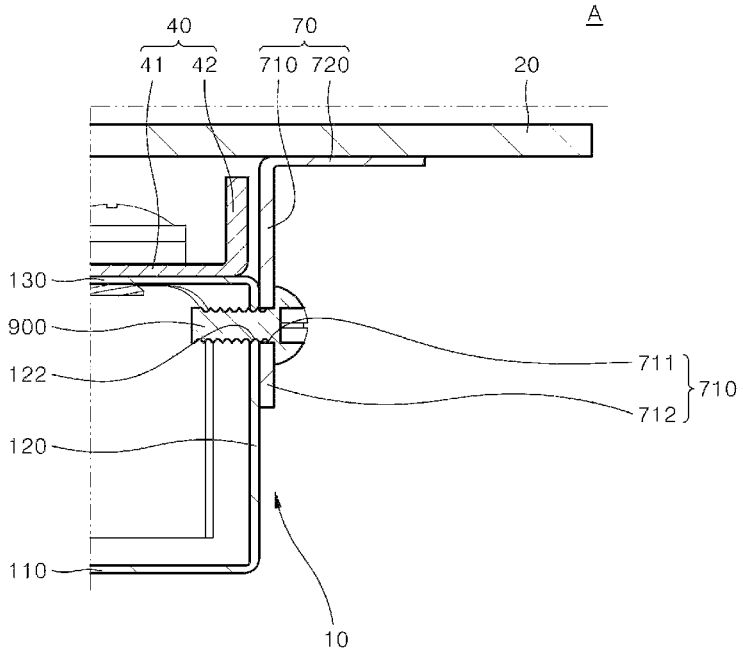
FIG. 9 is an enlarged view showing portion A according to the embodiment shown in FIG. 5.
Figure 10:
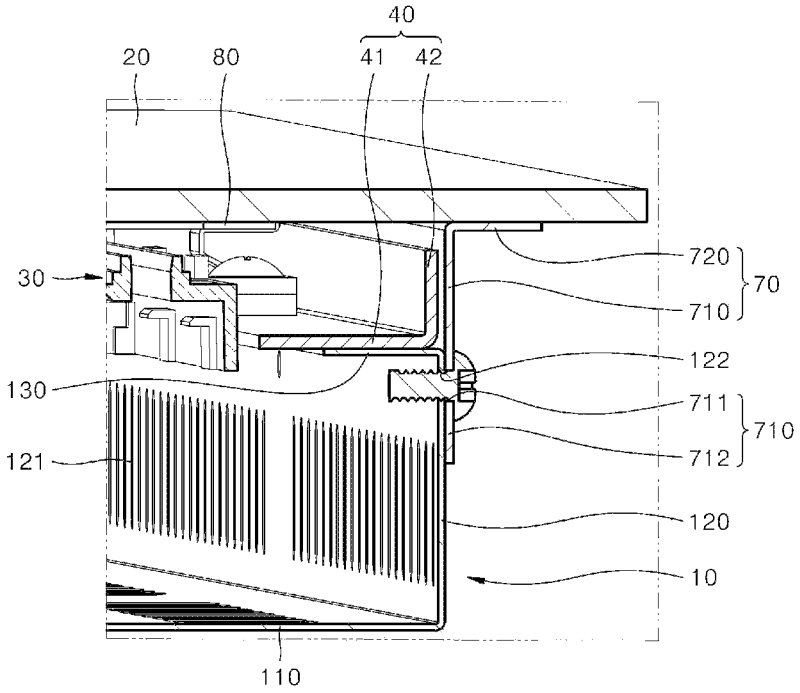
FIG. 10 is a perspective view according to an embodiment shown in FIG. 9.

FIG. 9 is an enlarged view showing portion A of FIG. 5. FIG. 10 is a perspective view of FIG. 9.

In one embodiment, the cover plate 20 may be mounted onto an electric range according to an embodiment of the present disclosure, using the cover bracket 70. For example, the cover plate 20 may be coupled to the case 10 or to the upper bracket 40 that may be built into the case 10.

In one embodiment, the cover bracket 70 may be coupled to the upper bracket 40, and a through hole may be formed on the first cover plate 710 of the cover bracket 70 and on the second upper plate 42 of the upper bracket 40. The first cover plate 710 and the second upper plate 42 may be coupled through or by a coupling tool since the first cover plate 710 and the second upper plate 42 may overlap in a horizontal or left-right direction of the electric range.

In this example, the second upper plate 42 may become deformed while the coupling tool is fastened to the second upper plate 42 since the second upper plate 42 may have a surface area much less or smaller than the surface area of the second casing 120 of the case 10.

For example, the first cover plate 710 and the second upper plate 42 have a through hole at or about portions where the first cover plate 710 and the second upper plate 42 overlap, unlike the first cover plate 710 and the second upper plate 42 illustrated in FIG. 9. A coupling tool may be inserted into the through holes to couple the first cover plate 710 and the second upper plate 42, and the second upper plate 42 may bend toward the first cover plate 710 during the coupling of the first cover plate 710 and the second upper plate 42.

It may be difficult to mount the cover bracket 70 without deforming or bending the second upper plate 42.

Additionally, the second upper plate 42 may block or prevent an electromagnetic field and electromagnetic waves generated in the heating part 30 mounted onto the upper bracket 40 from escaping out of the upper bracket 40.

However, if the second upper plate 42 is deformed for the above described reasons, the second upper plate 42 may not adequately block the electromagnetic field and electromagnetic waves, as designed. Thus, the EMC and EMI of the electric range may deteriorate.

In one embodiment, the cover bracket 70 may be easily mounted onto the electric range. Further, when the cover bracket 70 is mounted, the deformation of the upper bracket 40 may be suppressed or prevented, thereby ensuring improvement in the EMC and EMI of the electric range.

The description in relation to the above described advantage may be provided with reference to FIGS. 4, 9, and 10. In FIG. 4, a screw bolt 900 is omitted for clarity of description and illustration.

Referring to FIGS. 4, 9, and 10, in the electric range of the embodiment, the first cover plate 710 of the cover bracket 70 and the second casing 120 of the case 10 may be coupled to each other. That is, the cover bracket 70 may be coupled to the case 10 disposed under the upper bracket 40, rather than being coupled to the upper bracket 40.

The first cover plate 710 and the second casing 120 may be coupled together by a screw bolt 900. Accordingly, the first cover plate 710 may be provided with a first passage hole 711, and the second casing 120 may be provided with a second passage hole 122 corresponding to the first passage hole 711.

The screw bolt 900 may be fastened to the first passage hole 711 and the second passage hole 122, and the first cover plate 710 may be coupled to the second casing 120. As a result, the cover bracket 70 may be coupled to the cover plate 20.

A plurality of first cover plates 710 may be provided to form each side of a rectangular shape. Accordingly, the first passage hole 711 may be formed on each of the first cover plates 710. A plurality of first passage holes 711 may be formed on each of the first cover plates 710, and each of the first passage holes 711 may be spaced apart from one another in a lengthwise direction of the first cover plate 710.

The number of first passage holes 711 formed on a single first cover plate 710 may be determined based on the size of the electric range, the coupling strength of the first cover plate 710, and the like. In this example, the number of the second passage holes 122 may correspond to the number of the first passage holes 711, and the second passage holes 122 may be disposed in or about positions corresponding to the positions of the first passage holes 711.

As illustrated in FIG. 4, the first cover plate 710 may further include a hole forming part 712 that protrudes downward, at or about a portion in which the first passage hole 711 is formed. The hole forming part 712 may increase the surface area of the first cover plate 710 at or about the portion in which the first passage hole 711 is formed, to ensure or provide a space for forming the first passage hole 711 in the first cover plate 710.

The hole forming part 712 may be formed at or about the portion of the first cover plate 710 where the first passage hole 711 is formed. Accordingly, the surface area of the first cover plate 710 may decrease, and the size and mass of the cover bracket 70 may decrease.

Additionally, the width of the first cover plate 710 may be relatively small at or about a portion of the first cover plate 710 except for the hole forming part 712. Accordingly, the possibility of the exhaust hole 121 being covered by the first cover plate 710 may be reduced.

As illustrated in FIG. 4, the first passage hole 711 may be formed into a slot hole with the diameter of the long or horizontal axis being greater than the diameter of the short or vertical axis.

Since the first passage hole 711 may be formed into a slot hole, the first passage hole 711 and the second passage hole 122 may easily correspond with each other during a fastening process, and the screw bolt 900 may be rotated easily and fastened to the first passage hole 711 and the second passage hole 122.

In this example, the diameter of the second passage hole 122 may be the same as or less than the diameter of the short or vertical axis of the first passage hole 711. Additionally, the first passage hole 711 may include a screw thread, the diameter of the second passage hole 122 may be the same as the diameter of the short or vertical axis of the first passage hole 711. Alternatively, the first passage hole 711 may not include a screw thread, and the diameter of the second passage hole 122 may be the same as or less than the diameter of the short or vertical axis of the first passage hole 711.

As illustrated in FIG. 9, the second upper plate 42 and the first cover plate 710 may be spaced apart from each other in the left-right or horizontal direction of the electric range of the present disclosure.

The upper bracket 40 may be mounted onto the third casing 130 of the case 10, and the first upper plate 41 of the upper bracket 40, and the third casing 130 may be coupled together by a coupling tool. In this embodiment, the upper bracket 40 may be reliably disposed on an upper side of the case 10.

In one embodiment, the second upper plate 42 and the first cover plate 710 may be kept spaced apart from each other without being coupled to each other. Accordingly, during mounting of the cover bracket 70 onto the electric range, any external force may not be applied to the second upper plate 42.

That is, the second upper plate 42 may not be deformed due to an external force during the process of mounting the cover bracket 70. Thus, the process of correcting the deformation of the second upper plate 42 is not required, and an installer can readily mount the cover bracket 70 onto the electric range.

Further, in this embodiment, since the second upper plate 42 is not deformed during the process of mounting the cover bracket 70, the second upper plate 42 may be mounted onto the electric range, thereby preventing a reduction in the EMC and EMI performance that may be caused by the deformation of the second upper plate 42. As a result, the EMC and EMI of the electric range may improve.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

What is claimed is:

1. An electric range, comprising:

a case;

a cover plate coupled to an upper surface of the case;

a plurality of heating parts disposed under the cover plate;

an upper bracket disposed under at least one of the plurality of heating parts to support the at least one of the plurality of heating parts;

a base bracket disposed under the upper bracket;

a printed circuit board disposed on the base bracket; and a plurality of cover brackets disposed outside the upper bracket and the case, wherein the plurality of cover brackets is coupled to the case to support the cover plate, and wherein each of the plurality of cover brackets is disposed about each of a plurality of sides of the cover plate.

2. The electric range of claim 1, wherein the case comprises:

a first casing forming a bottom surface of the case;

a second casing bent from the first casing to form a plurality of surfaces of the case; and a third casing bent from the second casing to support the upper bracket.

3. The electric range of claim 2, wherein each of the plurality of cover brackets comprises:

a first cover plate disposed to face the second casing and coupled to the second casing; and a second cover plate bent from the first cover plate to support the cover plate.

4. The electric range of claim 3, wherein the first cover plate comprises a first passage hole, wherein the second casing comprises a second passage hole, and wherein a fastener is fastened to the first passage hole and the second passage hole to affix each of the plurality of cover brackets to the cover plate.

5. The electric range of claim 2, further comprising:

a plurality of first cover plates forming a plurality of sides of a rectangular shape;

a plurality of first passage holes disposed on each of the plurality of first cover plates, each of the plurality of first passage holes being spaced apart from one another in a first direction; and a plurality of second passage holes disposed in positions corresponding to positions of the first passage holes.

6. The electric range of claim 4, wherein the first cover plate further comprises a hole forming part protruding downward and extending below the first passage hole, the hole forming part located at a portion of the first cover plate in which the first passage hole is formed.

7. The electric range of claim 4, wherein the first passage hole is a slot hole, and wherein a diameter of a first axis of the slot hole is greater than a diameter of a second axis of the slot hole.

8. The electric range of claim 3, wherein the upper bracket comprises:

a first upper plate forming a bottom surface of the upper bracket; and a second upper plate bent from the first upper plate, wherein the second upper plate is disposed to face the first cover plate.

9. The electric range of claim 8, wherein the second upper plate and the first cover plate are spaced apart from each other.

10. The electric range of claim 2, wherein the second casing further comprises a plurality of exhaust holes.

11. The electric range of claim 10, wherein the plurality of surfaces formed by the second casing forms a rectangular shape, and the plurality of exhaust holes are disposed on each of the plurality of surfaces formed by the second casing.

12. An electric range, comprising:

a case;

a cover plate coupled to an upper surface of the case;

a plurality of heating parts disposed under the cover plate;

an upper bracket disposed under at least one of the plurality of the heating parts to support the at least one of the plurality of heating parts;

a base bracket disposed under the upper bracket, a printed circuit board disposed on the base bracket;

at least one of a plurality of cover brackets coupled to the case by a fastener, the plurality of cover brackets supporting the cover plate, wherein each of the plurality of cover brackets is disposed about each of a plurality sides of the cover plate.

13. The electric range of claim 12, the case, comprising:

a first casing forming a bottom surface of the case;

a second casing bent from the first casing to surround a plurality of sides of the base bracket; and a third casing bent from the second casing to couple to the upper bracket.

14. The electric range of claim 13, each of the plurality of cover brackets, comprising:

a first cover plate disposed to face the second casing and coupled to the second casing; and a second cover plate bent from the first cover plate to support the cover plate, wherein the second casing comprises a plurality of exhaust holes.

15. The electric range of claim 14, wherein the fastener is a screw bolt.

16. The electric range of claim 4, wherein the second passage hole is smaller than the first passage hole.

17. The electric range of claim 5, wherein a number of the plurality of the first passage holes correspond to a number of the plurality of the second passage holes.

18. The electric range of claim 3, wherein the second cover plate is bent orthogonal to the first cover plate.

19. The electric range of claim 8, wherein the second upper plate is bent orthogonal to the first upper plate.

* * * * *